US009107494B2

(12) United States Patent
Scheuring et al.

(10) Patent No.: US 9,107,494 B2
(45) Date of Patent: Aug. 18, 2015

(54) REFRIGERATOR WITH A LIFT MECHANISM INCLUDING AT LEAST ONE PIVOT ARM

(71) Applicant: Electrolux Home Products, Inc., Charlotte, NC (US)

(72) Inventors: Joseph Scheuring, Anderson, SC (US); Michael Bayne, Easley, SC (US)

( * ) Notice: Subject to any disclaimer, the term of this patent is extended or adjusted under 35 U.S.C. 154(b) by 0 days.

(21) Appl. No.: 13/827,229

(22) Filed: Mar. 14, 2013

(65) Prior Publication Data

US 2014/0265797 A1 Sep. 18, 2014

(51) Int. Cl.

| | |
|---|---|
| ***A47B 96/04*** | (2006.01) |
| ***A47B 51/00*** | (2006.01) |
| ***F25D 25/02*** | (2006.01) |
| *A47B 88/00* | (2006.01) |

(52) U.S. Cl.

CPC ..... *A47B 51/00* (2013.01); *F25D 25/025* (2013.01); *A47B 2088/0081* (2013.01); *A47B 2210/17* (2013.01)

(58) Field of Classification Search

CPC ..... F25D 25/025; F25D 25/04; F25D 23/024; F25D 23/00; F25D 23/04; A47B 51/00; A47B 2210/17; A47B 2088/0081; A47L 15/504; A47L 15/506

USPC ..... 312/402, 404, 310, 334.4, 272, 319.5, 312/319.8, 330.1; 211/41.8

See application file for complete search history.

(56) References Cited

U.S. PATENT DOCUMENTS

| | | | | | |
|---|---|---|---|---|---|
| 2,769,678 | A | | 11/1956 | Wolters | |
| 2,812,226 | A | | 11/1957 | Wolters | |
| 3,282,566 | A | * | 11/1966 | Clarke | 254/122 |
| 3,472,183 | A | * | 10/1969 | Goodman | 108/147 |
| 3,862,788 | A | | 1/1975 | Hock | |
| 3,982,801 | A | | 9/1976 | Heidorn et al. | |
| 4,556,198 | A | * | 12/1985 | Tominaga | 254/122 |
| 4,558,648 | A | * | 12/1985 | Franklin et al. | 108/147 |
| 4,558,847 | A | * | 12/1985 | Coates | 254/9 C |
| 4,582,310 | A | * | 4/1986 | Hahn | 5/611 |
| 5,115,822 | A | | 5/1992 | Nichols | |
| 5,971,513 | A | | 10/1999 | Cassalia | |

(Continued)

FOREIGN PATENT DOCUMENTS

| | | | |
|---|---|---|---|
| CN | 202057149 | U | 11/2011 |
| EP | 2218993 | A2 | 8/2010 |

OTHER PUBLICATIONS

International Search Report issued in Application No. PCT/US2014/023250 dated Jul. 22, 2014.

(Continued)

*Primary Examiner* — Daniel J Troy

*Assistant Examiner* — Ryan A Doyle

(74) *Attorney, Agent, or Firm* — Pearne & Gordon LLP

(57) ABSTRACT

A refrigerator is provided including a refrigerator compartment having a bin door. A storage bin is positioned within the refrigerator compartment. A lift mechanism is positioned within the refrigerator compartment. The lift mechanism includes a bin support structure configured to support the storage bin. The lift mechanism further includes at least one pivot arm pivotally attached to the bin door, and a drive unit attached to the bin door. The drive unit applies a vertical force to the at least one pivot arm, and rotation of the at least one pivot arm vertically moves the bin support structure and storage bin.

20 Claims, 6 Drawing Sheets

(56) References Cited

U.S. PATENT DOCUMENTS

| | | | | |
|---|---|---|---|---|
| 6,038,986 | A * | 3/2000 | Ransil et al. | 108/145 |
| 6,247,771 | B1 | 6/2001 | Miller | |
| 6,510,858 | B1 | 1/2003 | Halstead et al. | |
| 6,523,919 | B1 | 2/2003 | Israelsen et al. | |
| 6,622,740 | B1 | 9/2003 | Durazzani | |
| 7,140,306 | B2 * | 11/2006 | Chen | 108/138 |
| 7,165,415 | B2 | 1/2007 | Nam et al. | |
| 7,225,898 | B2 * | 6/2007 | Bourgeois | 187/200 |
| 7,232,196 | B2 | 6/2007 | Kwon et al. | |
| 7,600,829 | B2 * | 10/2009 | Oh et al. | 312/404 |
| 7,600,830 | B2 * | 10/2009 | Oh et al. | 312/404 |
| 7,600,833 | B2 * | 10/2009 | Oh et al. | 312/404 |
| 8,065,966 | B1 * | 11/2011 | Bacon et al. | 108/145 |
| 2004/0163687 | A1 | 8/2004 | Son et al. | |
| 2004/0244825 | A1 * | 12/2004 | Ashton | 134/85 |
| 2005/0073225 | A1 * | 4/2005 | Kwon et al. | 312/402 |
| 2005/0172657 | A1 | 8/2005 | Hwang | |
| 2006/0021373 | A1 * | 2/2006 | Oh et al. | 62/407 |
| 2006/0022564 | A1 * | 2/2006 | Oh et al. | 312/402 |
| 2006/0042305 | A1 * | 3/2006 | Oh et al. | 62/407 |
| 2006/0043848 | A1 | 3/2006 | Jeong | |
| 2006/0043849 | A1 * | 3/2006 | Oh et al. | 312/310 |
| 2006/0087207 | A1 | 4/2006 | Oh et al. | |
| 2006/0087208 | A1 | 4/2006 | Oh et al. | |
| 2006/0096304 | A1 | 5/2006 | Kim et al. | |
| 2006/0097611 | A1 | 5/2006 | Kim et al. | |
| 2006/0103273 | A1 * | 5/2006 | Lee et al. | 312/236 |
| 2006/0104756 | A1 | 5/2006 | Kim et al. | |
| 2006/0196198 | A1 | 9/2006 | Kim et al. | |
| 2006/0207283 | A1 | 9/2006 | Kim et al. | |
| 2006/0226749 | A1 | 10/2006 | Kim | |
| 2006/0242988 | A1 * | 11/2006 | Kim et al. | 62/441 |
| 2007/0169767 | A1 | 7/2007 | Chung | |
| 2008/0018215 | A1 | 1/2008 | Carden | |
| 2008/0238278 | A1 * | 10/2008 | Jeong et al. | 312/404 |
| 2009/0058240 | A1 * | 3/2009 | Stuwe | 312/248 |
| 2009/0266778 | A1 * | 10/2009 | Garcia et al. | 211/89.01 |
| 2010/0257671 | A1 * | 10/2010 | Shimada et al. | 5/611 |
| 2010/0314977 | A1 * | 12/2010 | Mallory et al. | 312/228.1 |
| 2012/0074075 | A1 * | 3/2012 | Garcia et al. | 211/1.57 |
| 2014/0191646 | A1 * | 7/2014 | Nuss et al. | 312/404 |

OTHER PUBLICATIONS

Written Opinion issued in Application No. PCT/US2014/023250 dated Jul. 22, 2014.

* cited by examiner

REFRIGERATOR WITH A LIFT MECHANISM INCLUDING AT LEAST ONE PIVOT ARM

FIELD OF THE INVENTION

The present invention relates generally to refrigerators, and more particularly, to refrigerators with a lift mechanism for lifting a storage bin.

BACKGROUND OF THE INVENTION

Traditional refrigerators have been designed with two refrigerator compartments positioned in various ways. For example, it is known to provide one refrigerator compartment above another refrigerator compartment. A lower storage compartment can include a storage bin.

BRIEF SUMMARY OF THE INVENTION

The following presents a simplified summary in order to provide a basic understanding of some example aspects. This summary is not an extensive overview of the invention. Moreover, this summary is not intended to identify critical elements of the invention nor delineate the scope of the invention. The sole purpose of the summary is to present some concepts in simplified form as a prelude to the more detailed description that is presented later.

In accordance with one aspect, refrigerator is provided comprising a refrigerator compartment, a storage bin positioned within the refrigerator compartment, and a lift mechanism positioned within the refrigerator compartment. The lift mechanism includes a bin support structure configured to support the storage bin, at least one pivot arm; and a drive unit, wherein the drive unit is configured to apply a force to the at least one pivot arm, further wherein rotation of the at least one pivot arm is configured to move the bin support structure and storage bin.

In accordance with another aspect, a refrigerator is provided comprising a refrigerator compartment including a bin door, a storage bin positioned within the refrigerator compartment, and a lift mechanism positioned within the refrigerator compartment. The lift mechanism includes a bin support structure configured to support the storage bin, at least one pivot arm pivotally attached to the bin door, wherein the at least one pivot arm includes a first end and a second end, wherein the second end of the at least one pivot arm is configured to engage the bin support structure, further wherein rotation of the at least one pivot arm is configured to move the bin support structure.

In accordance with another aspect, a refrigerator is provided comprising a refrigerator compartment including a bin door, a storage bin positioned within the refrigerator compartment, and a lift mechanism positioned within the refrigerator compartment. The lift mechanism includes a bin support structure configured to support the storage bin, and a drive unit attached to the bin door and in operative association with the bin support structure, wherein the drive unit is configured to output vertical upward motion causing the bin support structure to lower, further wherein the drive unit is configure to output vertical downward motion causing the bin support structure to rise.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
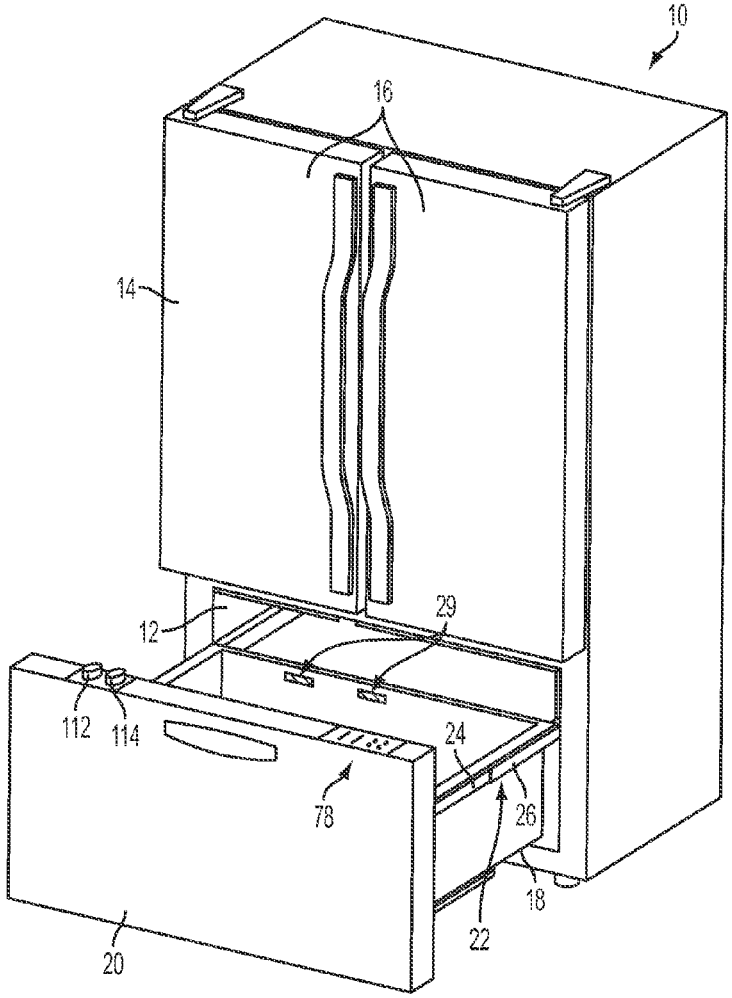
FIG. 1 is a perspective view of a bottom-mount refrigerator freezer including a lower compartment.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Referring to the example of FIG. 1, a refrigerator 10 is shown with two refrigerator compartments. The refrigerator 10 may include an upper compartment 14 and a lower compartment 12. The upper compartment 14 can include one or more refrigerator doors 16 that provide access to an interior portion of the upper compartment 14. While not shown in the example, the refrigerator 10 can also include a cooling system with a compressor, heat-exchange pipes, an expansion valve, refrigerant, etc. in order to cool the refrigerator compartments.

While FIG. 1 illustrates a two compartment refrigerator, the refrigerator 10 can also include a single compartment or more than two compartments. Moreover, if provided with two or more compartments, one or more may by located above the other and/or laterally with respect to one another. Still further, one compartment may be located partially or entirely within another compartment. Similarly, either one or both compartments may be maintained at a temperature above or below freezing providing for two freezers, two refrigerators, or one freezer and one refrigerator. In the shown examples, the lower compartment 12 may be kept at a temperature below freezing, such that the lower compartment 12 is functionally a freezer compartment.

The refrigerator 10 can include a bin door 20 configured to cover the lower compartment 12. The bin door 20 can include a handle, or the like, to allow a user to open and close the bin door 20. The bin door 20 can be attached to and supported by a sliding mechanism. The sliding mechanism can include at least one slide, though, in the shown example, there are two slides 22. The slides 22 can extendably move the bin door 20 between an open position and closed position. Accordingly, the slides 22 can move the bin door 20 back and forth into and out of the lower compartment 12. The slides 22 can include a first slide and a second slide, such that each slide can be provided on one side of the bin door 20. The slides 22 may be drawer slides that include an inner rail 24 and an outer bracket 26. The inner rail 24 may be slidingly received within the outer bracket 26. The slides 22 may be attached to the bin door 20 and lower compartment 12 at opposing ends, such that the outer bracket 26 can be attached within the lower compartment 12 while the inner rail 24 can be attached to the bin door 20. It is to be understood, however, that various configurations of the slides 22 are envisioned, and the present example is not limited to the inner rail 24 and outer bracket 26. For instance, in another example, the outer bracket 26 could be slidingly received within the inner rail 24.

A storage bin 18 may be positioned between the slides 22, including the first slide and the second slide, positioned within the lower compartment 12. Accordingly, when the bin door 20 is withdrawn into an open position as shown in FIG. 1, the storage bin 18 can be configured to move out of the lower compartment 12 along with the bin door 20 by the slides 22. Accordingly, when the bin door 20 is moved into the closed position, the slides 22 can slide the bin door closed such that the storage bin 18 is configured to move into the lower compartment 12. With the slides 22 attached to the bin door at one end, the storage bin 18 can rest on the slides 22 and be readily removed.

The storage bin 18 may have various configurations to fit within the lower compartment 12. In one example, the storage bin 18 can have a generally rectangular box shape, open on the top to provide access to the storage area defined by the bin. The storage bin 18 may be formed of metal, plastic, or any other suitable material. The storage bin 18 may also include one or more lights 29 configured to illuminate the contents of the storage bin 18. The lights 29 can be mounted on the front side of the storage bin 18 to illuminate the storage bin 18 and its contents without being directly visible to the user. It is to be understood, however, that the lights 29 can be positioned on any, or all of the sides of the storage bin 18. For instance, the lights 29 can be positioned on a side and/or rear of the storage bin 18. Similarly, the lights 29 could be positioned on the bin door 20 or within the lower compartment 12.

Figure 2:
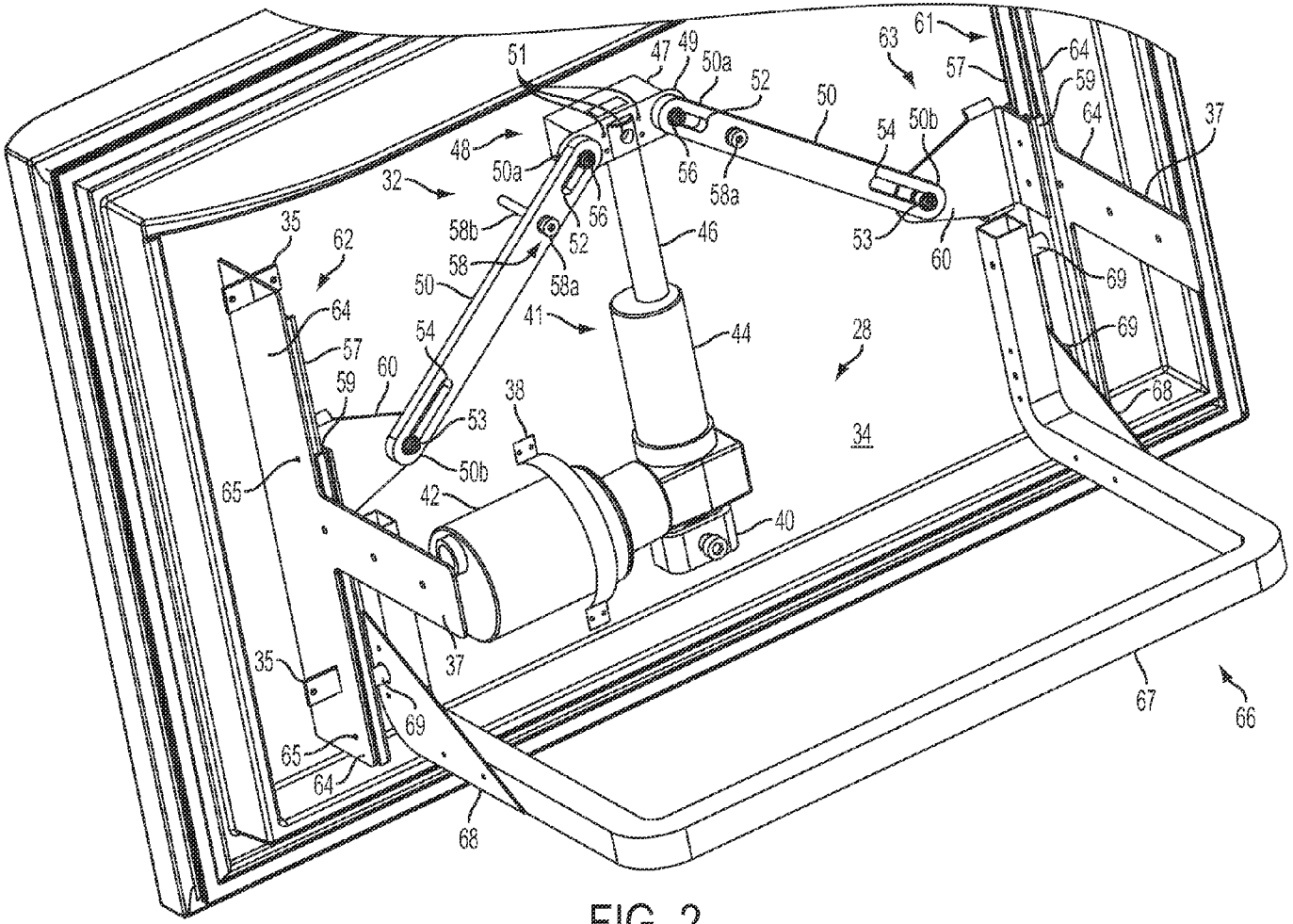
FIG. 2 is a rear perspective view of a lift mechanism in the lower compartment in which a storage bin has been removed.

Turning now to FIG. 2, the bin door 20 can include a bin mounting structure 34. The bin mounting structure 34 can include a substantially planar metal surface provided on a rear portion of the bin door 20. The bin mounting structure 34 can be attached to the bin door 20, such that the bin mounting structure 34 moves with the bin door 20 into and out of the lower compartment 12. Alternatively, the bin mounting structure 34 can be formed as the bin door 20, such that a front surface of the bin mounting structure 34 constitutes the front face of the bin door 20. As will be described below, the bin mounting structure 34 can support a variety of structures.

The bin door 20 can include a door bracket 64. The door bracket 64 can be attached to the bin mounting structure 34 by one or more mounting brackets 35, though a variety of attachment structures are envisioned. The door bracket 64 can extend perpendicularly from the bin mounting structure 34. The door bracket 64 can have a substantially planar surface with an attachment portion 37 extending from the door bracket 64. The attachment portion 37 can include one or more holes and can be attached to the slides 22. The holes can allow for an attachment structure, such as screws, pins, bolts, and the like to attach the inner rail 24 to the attachment portion 37. Specifically, the inner rail 24 can be attached to the attachment portion 37 such that withdrawal of the bin door 20 can cause the door bracket 64 to pull the slides 22 out from the lower compartment 12.

A lift mechanism 32 is provided for lifting the storage bin 18 from a lower position to an upper position, and from an upper position back to a lower position. Though the shown example of FIG. 2 does not include the storage bin 18 for illustrative purposes, it is to be understood that the storage bin 18 could be provided with the lift mechanism 32. The distance of travel between the upper and lower positions may vary for different refrigerator designs. For example, the distance of travel may be from about 5 to 15 inches, or from about 8 to 10 inches. The lift mechanism 32 may be configured to rapidly move the storage bin 18 between the lower and upper positions and vice versa. For example, the lift mechanism 32 may move between the lower position and the upper position in less than 10 seconds, or in less than 5 seconds. As will be discussed below, lifting or lowering of the storage bin 18 by the lift mechanism 32 may occur automatically upon withdrawing or replacing the storage bin 18 from the lower compartment 12, or it may occur when a signal is provided by the user to raise or lower the storage bin 18. Raising the storage bin 18 may provide easier access to an interior portion of the storage bin 18.

The lift mechanism 32 can include a sliding system 63 configured to provide vertical or substantially vertical motion to the storage bin 18. The sliding system 63 can be operatively attached either directly to the bin mounting structure 34 or, as shown in the drawings, can be operatively attached to the bin mounting structure 34 through the door bracket 64. The sliding system 63 can include slide rails 61, 62 and lift brackets 60.

The sliding system 63 can include at least one slide rail. More specifically, the sliding system 63 can include a first slide rail 61 and a second slide rail 62 configured to provide vertical or substantially vertical movement of the storage bin 18. The slide rails 61, 62 can be attached in a number of locations within the lower compartment 12. For instance, in the shown example, the slide rails 61, 62 can be removably attached to the door bracket 64. In further examples, the slide rails 61, 62 could be attached to the slides 22 and/or directly to the bin door 20. The slide rails 61, 62 can be removably attached by a variety of different mounting structures. For instance, in the shown example of FIG. 4, one or more screws 65 can be used to attach the slide rails 61, 62 to the door bracket 64. In further examples, adhesives, welding, a snap fit means, or the like could be used to attach the slide rails 61, 62 to the door bracket 64.

The slide rails 61, 62 can each include a fixed rail 57 and a moving rail 59. The fixed rail 57 can be attached to the door bracket 64 by the screws 65, as described above, such that the fixed rail 57 is non-movably secured to the door bracket 64. The fixed rail 57 can have an elongated C-shape, though other possible shapes are possible. The fixed rail 57 can be vertically or substantially vertically oriented, such that the fixed rail 57 can extend from a lower portion of the door bracket 64 to an upper portion of the door bracket 64.

The fixed rail 57 can be telescopingly received within the moving rail 59. The moving rail 59 can also have an elongated C-shape and can be sized slightly larger than the fixed rail 57 such that the moving rail 59 can slidably engage the fixed rail 57. For instance, the moving rail 59 can engage the fixed rail 57 by a snap fit means, or the like, such that the moving rail 59 can slide with respect to the fixed rail 57 without being removed from the fixed rail 57. The moving rail 59 can be shorter in length than the fixed rail 57, such that the moving rail 59 can slide along the length of the fixed rail 57. The fixed rail 57 and moving rail 59 can include a number of different materials, such as metal, plastic, a metal/plastic mixture, etc. Furthermore, a number of slide rail variations are contemplated. For instance, while the moving rail 59 is sized to receive the fixed rail 57, it is to be understood that the fixed rail 57 could instead be sized to receive the moving rail 59. Similarly, other configurations of telescoping rails as are known in the art are contemplated. In further examples, a lower and upper limit means can be provided (not shown) to limit the maximum upward and downward distance that the moving rail 59 can travel with respect to the fixed rail 57. As such, the moving rail 59 can remain in engagement at all times with the fixed rail 57.

The sliding system 63 can further include two lift brackets 60. The lift brackets 60 can be attached to the moving rail 59 such that when the moving rail 59 moves up and down, the lift brackets 60 can move up and down as well. In the shown example, the lift brackets 60 can be attached to the moving rail 59 by two pins, though the attachment can be made in a number of ways. For instance, any type of attachment structure can be used, such as a screw and bolt assembly, mechanical fasteners, snap fit means, etc. Similarly, adhesives, welding, or the like could also be used to attach the lift brackets 60 to the moving rail 59. Each of the lift brackets 60 can further include a pin 53 attached to the lift bracket 60 and extending from the lift bracket 60 towards the storage bin 18. The pin 53 can be positioned at a variety of locations on the surface of the lift bracket 60. The pin 53 can include a skinnier portion and a wider portion at the end of the pin 53. As will be described below, the pin 53 can assist in transferring vertical motion to the sliding system 63.

The lift mechanism 32 can further include a bin support structure 66. The bin support structure 66 can be configured to support and move the storage bin 18. The bin support structure 66 can be slidably attached to the moving rail 59, such that the bin support structure 66 moves vertically with the moving rail 59 to raise and lower the storage bin 18.

The bin support structure 66 can include a bin support shelf 67 configured to support a bottom surface of the storage bin 18. The bin support shelf 67 can be formed of a tube bent substantially into a U-shape. The bin support shelf 67 can include upwardly projecting ends that are attachable to the moving rail 59. It is to be understood that the bin support shelf 67 can take on a number of shapes and still support the storage bin 18. For instance, the bin support shelf 67 can be substantially V-shaped, or have one or more support bars (not shown) extending between the U-shape. Moreover, the bin support shelf 67 can include a flat surface inside the U-shape to provide further support for the storage bin 18. The bin support shelf 67 can include a number of different materials to provide sufficient strength. For instance, the bin support shelf 67 can be formed of stainless steel, titanium, plastic, etc. or a combination of materials.

Figure 4:
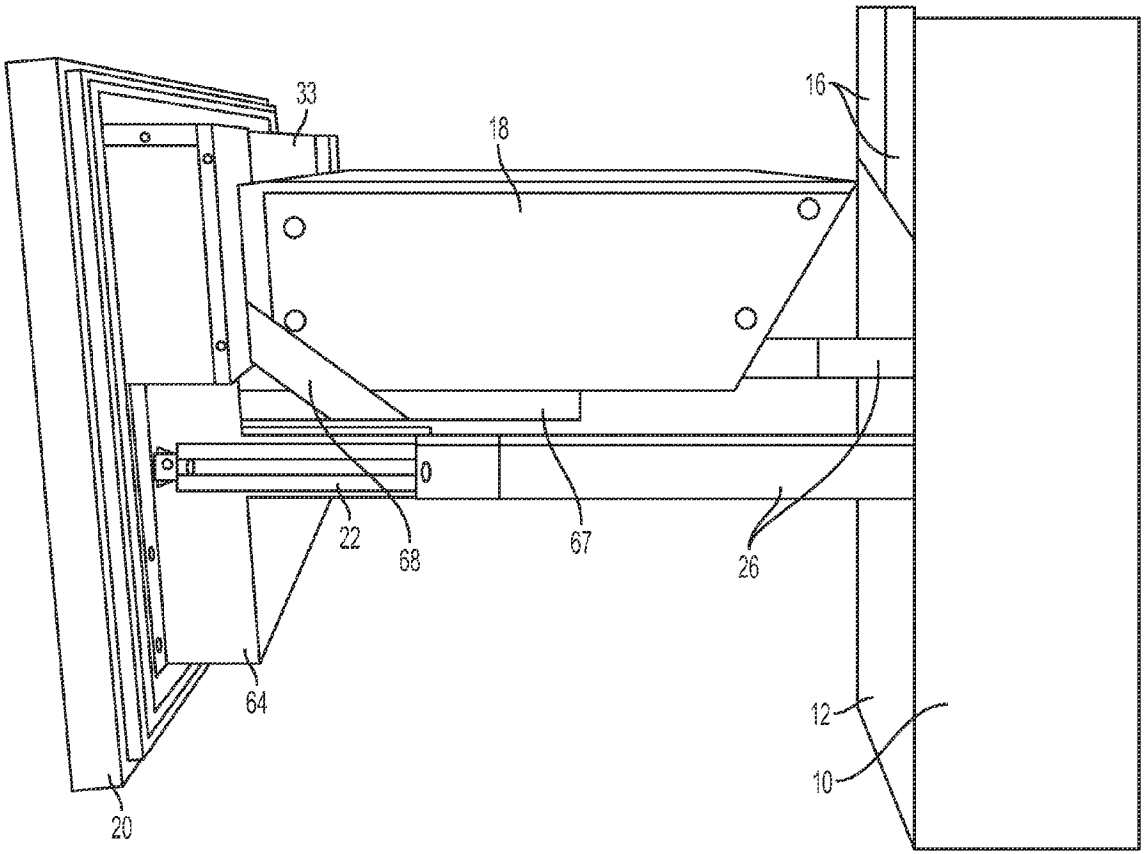
FIG. 4 is another side perspective view of the storage bin in a raised position attached to the bin door.

The bin support structure 66 can also include a pair of bin support brackets 68 that can provide further support to the bin support shelf 67. Each of the bin support brackets 68 can include a triangularly shaped planar piece of material, such as metal or plastic, and can project between portions of the bin support shelf 67. In the shown example, the bin support brackets 68 can project between the upwardly projecting end of the bin support shelf 67 and the U-shaped portion of the bin support shelf 67. The bin support brackets 68 can be attached to the bin support shelf 67 by a number of different attachment structures, including screws, as shown in the example, pins, adhesives, and the like. Further, it is to be understood that the bin support brackets 68 can include a number of different structures, and are not limited to the triangularly shaped piece. For instance, the bin support brackets 68 can include a single strip of material or, can extend further along the side of the bin support shelf 67. The bin support brackets 68 can be spaced apart a predetermined distance that is slightly wider than the width of the storage bin 18. Accordingly, as can be seen in FIG. 4, each of the bin support brackets 68 can be positioned near the edges of the storage bin 18 so as to be substantially flush and reduce side to side movement of the storage bin 18. Furthermore, the bin support brackets 68 can provide additional support to the bin support shelf 67. This additional support may reduce a bending moment on the bin support shelf 67 caused by the weight of the storage bin 18. In further examples, the bin support brackets 68 can include an attachment structure (not shown) configured to attach the storage bin 18 to the bin support brackets 68. The attachment structure could include a screw and bolt assembly, and adhesive or welding, a snap fit means, etc. Accordingly, the storage bin 18 can be attached to the bin support brackets 68 for additional support.

The bin support structure 66 can further include a plurality of bin support pins 69 attaching the bin support shelf 67 to the moving rail 59. The bin support pins 69 can include a variety of types of attachment structures, such as nuts and bolts, threaded screws, snap fit means, adhesives, welding, etc. Further, while the shown example of FIG. 4 shows the bin support pins 69 including two pins mounted to each moving rail 59, it is to be understood that more pins could be used to provide additional support. The bin support pins 69 can be integrally formed with either of the bin support shelf 67 or the moving rail 59, or can be attached as separate structures to each. In the shown example, each of the bin support pins 69 can be fixedly attached to the moving rail 59 at one side, and fixedly attached to the bin support shelf 67 at an opposing side. In addition, the lower pin of the bin support pins 69 can extend through a hole in the bin support brackets 68, such that the bin support brackets 68 do not interfere with the attachment. The bin support pins 69 can be formed of a material sufficiently strong enough to support the weight of the storage bin 18 and the contents of the storage bin 18, and can include metal, such as steel, aluminum, titanium, etc. plastic, or a combination of materials.

The operation of the sliding system 63 and the bin support structure 66 can now be discussed. A force can be provided to the lift bracket 60 through the pin 53. The lift bracket 60 can respond to the force by moving either in an either upwards or downwards direction. Movement of the lift bracket 60 can further cause the moving rail 59 to move with respect to the fixed rail 57, since the lift bracket 60 and moving rail 59 are attached to each other. The upward or downward movement of the moving rail 59 with respect to the fixed rail 57 can further cause the bin support structure 66 to move. Movement of the moving rail 59 can be transferred to the bin support shelf 67 through the bin support pins 69. The bin support shelf 67 will then move upwards or downwards. Accordingly, since the bin support shelf 67 supports the storage bin 18, the storage bin 18 can move upwards or downwards as well.

The lift mechanism 32 can further include a first drive unit 28 that provides a vertical or substantially vertical force to move the storage bin 18 between a raised position and a lowered position. To accomplish this, the first drive unit 28 can include a motor 42. The motor 42 can include nearly any type of AC or DC motor that is known in the art, and is not limited to the example motor shown in the example. For instance, the motor 42 can include a servomotor, electrostatic motor, torque motor, stepper motor, etc. The motor 42 can include wires (not shown) for delivering power to the motor 42. Similarly, the speed and torque requirements for the motor 42 can be chosen to accommodate the predetermined weight of the storage bin 18 and lifting speed. The motor 42 can provide output in multiple directions, such as a first direction of rotation and a second direction of rotation, such that a lifting output and a lowering output can be provided. In one example, the motor 42 can include a drive cylinder with a worm gear (not shown). The motor 42 can rotate the worm gear in either a clockwise or counterclockwise direction.

The motor 42 can be attached to the rear of the bin mounting structure 34. The motor 42 can be attached in a number of ways. For instance, in the shown example, the motor 42 can be attached to the bin mounting structure 34 with a bracket 38. The bracket 38 can extend around the motor 42 and can be bolted to the bin mounting structure 34 to hold the motor 42 in place. However, other attachment means are contemplated, such as multiple brackets, a snap fit attachment, adhesives, the motor 42 fitting into a groove, aperture, or the like in the bin mounting structure 34, etc. Similarly, the motor 42 is shown to be positioned in a horizontal orientation on the lower left hand side of the bin mounting structure 34. However, the motor 42 can be positioned in a number of locations, such as on the right hand side, the lower right hand side, etc.

The motor 42 can be operatively attached to a lifting device 41. The lifting device 41 can be vertically oriented and can convert output motion from the motor 42 into vertical movement. As will be described below, this vertical movement can thus cause the bin support shelf 67 to move between the raised and the lowered position.

The lifting device 41 can include a fixed cylinder 44 configured to telescopingly receive a moving cylinder 46. The fixed cylinder 44 can include an elongated cylinder with a substantially hollow center. The fixed cylinder 44 can be fixedly attached to the bin mounting structure 34 such that a lower end of the fixed cylinder 44 engages the motor 42. In the shown example, a pivot mount 40 and a pin can be provided to attach the fixed cylinder 44 to the bin mounting structure 34. The pivot mount 40 can surround a portion of the fixed cylinder 44 while the pin can pass through a hole in both of the pivot mount 40 and fixed cylinder 44. The pin can pass through both structures and attach to the bin mounting structure 34. As such, the pivot mount 40 and pin can fixedly secure the fixed cylinder 44 to the bin mounting structure 34. It is to be understood, however, that the attachment means is not limited to the pivot mount 40 shown in the example, and that other attachment means are contemplated. For instance, multiple brackets could be provided, the pivot mount could be positioned at a different location along the length of the fixed cylinder, various screw and bolt assemblies and/or adhesives or welding could be used. The fixed cylinder 44 can engage the motor 42. The fixed cylinder 44 can include a screw drive (not shown) configured to engage the worm gear (not shown) of the motor 42.

The substantially hollow center of the fixed cylinder 44 can be sized to receive the moving cylinder 46. The moving cylinder 46 can be an elongated metal cylinder configured to move vertically up and down with respect to the fixed cylinder 44. A lubricant can be provided between the fixed cylinder 44 and the moving cylinder 46, such that the moving cylinder 46 can move smoothly up and down with a minimum amount of friction and resistance. The moving cylinder 46 can engage the screw drive (not shown) of the fixed cylinder 44, such that movement of the screw drive can cause the moving cylinder 46 to move upwards and downwards.

The operation of the first drive unit 28 can now be explained. The motor 42 can be operatively attached to the lower end of the lifting device 41. Specifically, the motor 42 can engage the fixed cylinder 44. The motor can rotate in one direction and cause the worm gear to rotate. The worm gear can engage the screw drive of the fixed cylinder. Rotation of the worm gear can cause the screw drive to move in an upward direction. This upward motion can engage a portion of the moving cylinder 46 and cause the moving cylinder 46 to move upwards. Accordingly, activation of the motor 42 can cause the moving cylinder 46 to translate vertically and in an upward direction with respect to the motor 42. The moving cylinder 46 can move out of the fixed cylinder 44. Similarly, activation of the motor 42 in an opposite direction can cause the moving cylinder 46 to translate vertically and in a downward direction with respect to the first drive unit 28. Accordingly, the moving cylinder 46 can move into the fixed cylinder 44.

The lift mechanism 32 can further include a connection link 48. The first drive unit 28, specifically the top of the moving cylinder 46, can be attached to a connection link 48. The connection link 48 can transmit vertical movement from the moving cylinder 46 to the bin support shelf 67. The connection link 48 can include a connection block 47 attached to a link bracket 49. The connection block 47 can be secured to the top of the moving cylinder 46, such that vertical movement of the moving cylinder 46 causes the connection block 47 to move as well. The connection block 47 can be secured to the moving cylinder 46 in a number of ways, including screws, adhesives, welding, or the like. The connection block 47 may further be secured to the link bracket 49. The link bracket 49 can include a substantially flat strip of material, such as metal, plastic, or the like. In the shown example, the link bracket 49 can be attached to the connection block 47 by one or more pins 51. It is to be understood, however, that a variety of attachment means are envisioned, such as threaded screws, adhesives, etc. Furthermore, the connection block 47 and link bracket 49 can be integrally formed as a single piece, such that the single piece can be attached to the moving cylinder 46. In further embodiments, the connection block 47 could be eliminated, such that the moving cylinder 46 can be attached directly to the link bracket 49. In these examples, the vertical movement of the moving cylinder 46 can still cause the link bracket 49 to move as well.

The link bracket 49 can further include pins 56 projecting outwardly from the link bracket 49 towards the storage bin 18. The pins 56 can include two pins, as in the shown example. The pins 56 can be screws, bolts, or the like, and can be fixed to the link bracket 49. The pins 56 can be positioned on opposing ends of the link bracket 49, such that the pins 56 are positioned equidistant from a center line. As such, each of the pins 56 is the same distance from the moving cylinder 46. It is to be understood, however, that the pins 56 can be positioned in varying locations, such as closer towards the center of the link bracket 49.

The lift mechanism 32 can further include at least one pivot arm 50. In certain applications, the at least one pivot arm 50 of the lift mechanism 32 may have a single pivot arm. As shown, it is also possible for the at least one pivot arm 50 to include two pivot arms, such as a left pivot arm and a right pivot arm, although three or more pivot arms may be incorporated in further examples. Providing two pivot arms may be desirable to provide support to each side of the bin support shelf 67. Although the pivot arms 50 may be different from one another, the illustrated pivot arms may be designed as substantial mirror images of one another.

The at least one pivot arm 50 can be an elongated beam-like structure having a first end 50*a* and a second end 50*b*. The first end 50*a* can be operatively attached to the connection link 48 and, thus, operatively attached to the first drive unit 28. Specifically, the first end 50*a* can be attached to the link bracket 49 by the pin 56. The first end 50*a* can include a first slot 52. The first slot 52 can be an elongated slot, slit, opening, or the like, and can extend through the at least one pivot arm 50. The first slot 52 can extend at least partially along the first end 50*a* and can be bounded on all four sides by the pivot arm 50. The first slot 52 can be substantially rectangularly shaped with rounded edges, though other shapes are contemplated. The first slot 52 can be sized to receive one of the pins 56. The pins 56 can each include a skinnier portion and a wider portion at the end of the pin 56. As such, each of the pins 56 can be sized to fit into the first slot 52, such that the wider portion at the end of the pin 56 holds the pivot arm 50 in engagement with the pin 56. Accordingly, one of the pins 56 can protrude from the link bracket 49 and pivotally, slidably attach the pivot arm 50 to the link bracket 49. The pivot arm 50 can pivot with respect to the pins 56 and link bracket 49 and, due to the first slot 52, the pivot arm 50 can slide with respect to the pins 56 and link bracket 49.

The at least one pivot arm 50 can further include the second end 50*b* located at an opposite end of the at least one pivot arm 50 from the first end 50*a*. The second end 50*b* can be attached to the lift bracket 60 and, thus, operatively attached to the bin support structure 66 and storage bin 18. Specifically, the second end 50*b* can be attached to the lift bracket 60 by the pin 53. The second end 50*b* can include a second slot 54. The second slot 54 can be an elongated slot, slit, opening, or the like, and can extend through the at least one pivot arm 50. The second slot 54 can extend at least partially along the second end 50*b* and can be bounded on all four sides by the at least one pivot arm 50. The second slot 54 can be substantially rectangularly shaped with rounded edges, though other shapes are contemplated. The second slot 54 can be sized to receive one of the pins 53. As such, the pin 53 can be sized to fit into the second slot 54, such that the wider portion at the end of the pin 53 holds the pivot arm 50 in engagement with the pin 53. Accordingly, the pin 53 can protrude from the lift bracket 60 and pivotally, slidably attach the pivot arm 50 to the lift bracket 60. The pivot arm 50 can pivot with respect to the pin 53 and lift bracket 60, and, due to the second slot 54, the pivot arm 50 can slide with respect to the pin 53 and lift bracket 60. Consequently, the second end 50*b* of the at least one pivot arm 50 can be indirectly attached to the bin support structure 66 through the lift bracket 60 and the at least one slide rail 61.

The at least one pivot arm 50 can further be rotatably attached to the rear of the bin mounting structure 34 of the bin door 20. The at least one pivot arm 50 can be attached by a pivot pin 58. The pivot pin 58 can extend between the bin mounting structure 34 at one end and the at least one pivot arm 50 at an opposite end. As such, the pivot pin 58 can provide for the at least one pivot arm 50 to pivot and rotate with respect to the bin mounting structure 34. The pivot pin 58 can include a number of different structures configured to allow pivotable rotation. For instance, the pivot pin 58 can include a pin 58*a* insertable into a receiving structure 58*b*. The receiving structure 58*b* can be fixedly attached to the bin mounting structure 34 in a number of ways. For instance, the receiving structure 58*b* can be attached by adhesives, welding, a screw and nut assembly, etc. The receiving structure 58*b* can include a slot for receiving the pin 58*a* at an end opposite from the bin mounting structure 34. The pin 58*a* can extend through a hole (not shown) provided at an intermediate portion of the at least one pivot arm 50. Accordingly, the pin 58*a* can pass through the hole and be insertably attached into the receiving structure 58*b*. The pin 58*a* can include an end sized to be larger than the hole in the at least one pivot arm 50. As such, the pin 58*a* can allow the at least one pivot arm 50 to pivot with respect to the pivot pin 58 while keeping the at least one pivot arm 50 attached to the bin mounting structure 34.

It is to be understood that the hole in the at least one pivot arm 50 can be provided at a variety of locations along the length of the at least one pivot arm 50. For instance, in the shown example, the hole and pivot pin 58 are provided closer to the first end 50*a*. However, the hole and pivot pin 58 can be provided closer to the center of the at least one pivot arm 50 or closer to the second end 50*b*. Moreover, a variety of structures can be used interchangeably in place of the pivot pin 58 shown in the examples. For example, the pivot pin 58 can include a single pin, bolt, screw, or the like, configured to extend through the hole in the at least one pivot arm 50 and attached to the bin mounting structure 34. As such, any number of structures can be provided that allow pivoting rotation between the at least one pivot arm 50 and the bin mounting structure 34.

Figure 3:
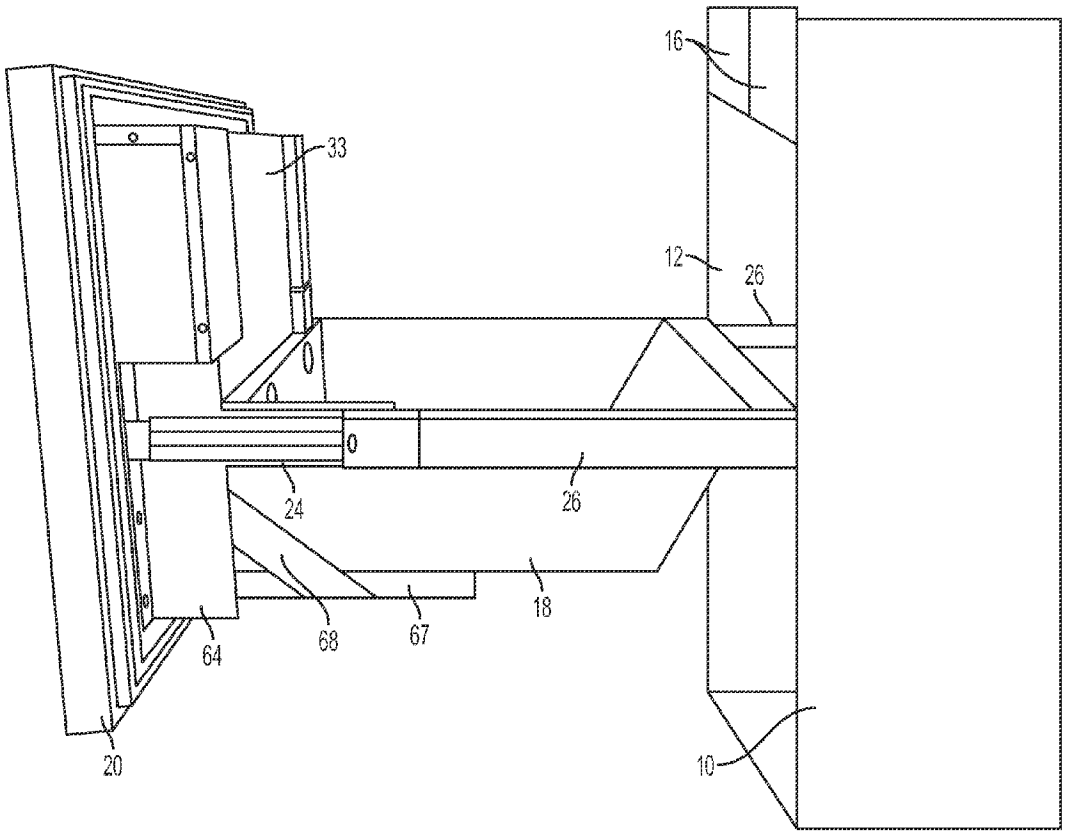
FIG. 3 is a side perspective view of the storage bin in a lowered position attached to a bin door.

Turning now to FIGS. 3 and 4, there is shown the storage bin 18 in a lowered position in FIG. 3, and in a raised position in FIG. 4. In the shown examples, the bin door 20 is withdrawn from the lower compartment 12. When the bin door 20 is in the fully withdrawn position, the storage bin 18 can be exposed to the user, such that the user can access the contents of the storage bin 18.

The bin door 20 can include a cover 33 that can cover the bin mounting structure 34. The cover 33 can provide aesthetic appeal as well as covering up any moving parts and preventing some, or all, pinch points. The cover 33 can be removably or non-removably attached to either the bin door 20 or the bin mounting structure 34. Further, the cover 33 can partially or completely cover the bin mounting structure 34. The cover 33 can be attached such that a gap is formed between the cover 33 and the bin mounting structure 34. The gap can allow for any structures and/or necessary parts to be positioned between the cover 33 and the bin mounting structure 34. The cover 33 can include one or more openings, slots, or the like to allow the necessary parts to freely travel within the lower compartment 12. Furthermore, the cover 33 can surround the lift mechanism 32 by being attached to the bin door 20. Accordingly, as shown in FIGS. 3 and 4, the lift mechanism 32 can be positioned within the bin door 20. The cover 33 can cover both the lift mechanism 32 and the bin mounting structure 34 with the lift mechanism 32 positioned in the gap between the cover 33 and the bin mounting structure 34.

The operation of the lift mechanism 32 can now be described. First, the raising of the storage bin 18 from the lowered position (FIG. 3) to the raised position (FIG. 4) will be described. When the motor 42 is activated, it can cause the worm gear (not shown) to rotate. The motor 42 can be attached to and in operative engagement with the fixed cylinder 44. Accordingly, the worm gear can engage the screw drive of the fixed cylinder 44 to cause the moving cylinder 46 to move in a downwardly direction with respect to the fixed cylinder 44. As the moving cylinder 46 moves downwards, it can be telescopingly received within the fixed cylinder 44. Downward motion of the moving cylinder 46 can correspondingly pull down the connection link 48. The pins 56 can move downwardly with the connection link 48, causing the at least one pivot arm 50 to pivot around the pivot pin 58.

Figure 5:
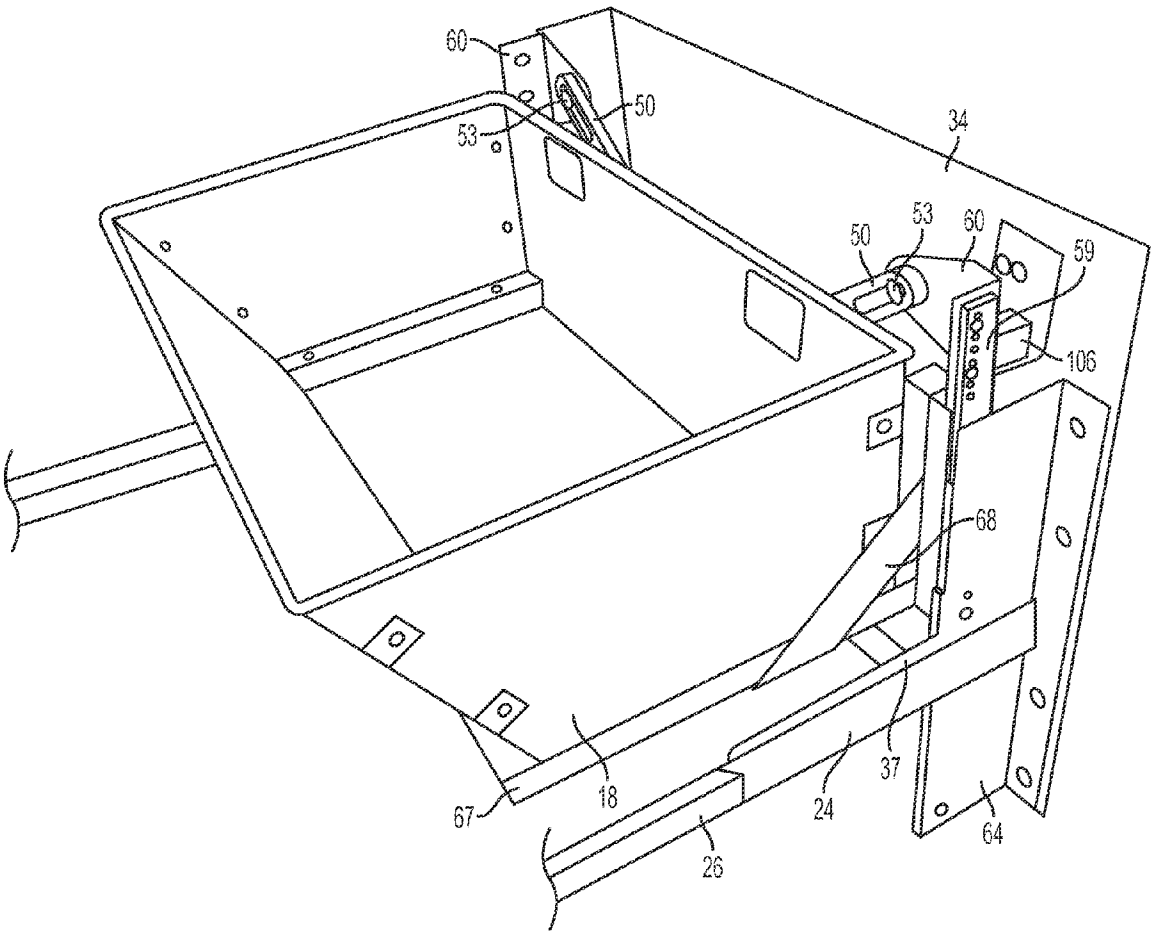
FIG. 5 is another perspective view of the lift mechanism with the storage bin in the raised position.

As shown in FIG. 5, the pivoting of the at least one pivot arm 50 occurs due to the first end 50*a* moving downwards while the second end 50*b* will move upwards. Upward motion of the second end 50*b* can correspondingly cause the lift bracket 60 to move upwardly as well due to the engagement between the pin 53 and the second slot 54. Accordingly, upward motion of the lift bracket 60 can cause the moving rail 59 and, thus, the bin support structure 66 to move upwardly as well. The upward motion of the bin support structure 66 includes the bin support shelf 67, which also raises the storage bin 18. Therefore, the storage bin 18 can be raised from the lowered to the raised position.

Next, the storage bin 18 can be lowered from the raised position (FIG. 4) to the lower position (FIG. 3). Similar to the raising motion, the lowering motion can be initiated by the activation of the motor 42 in an opposite direction. The motor 42 can cause the worm gear (not shown) to rotate, which causes the worm gear to engage the screw drive of the fixed cylinder 44. This engagement can cause the moving cylinder 46 to move in an upwardly direction with respect to the fixed cylinder 44. As the moving cylinder 46 moves upwards, it can slide out of the fixed cylinder 44. Upward motion of the moving cylinder 46 can correspondingly drive the connection link 48 upwards. The pins 56 can move upwardly with the connection link 48, causing the at least one pivot arm 50 to pivot around the pivot pin 58. The pivoting of the at least one pivot arm 50 occurs due to the first end 50*a* moving upwards. Consequently, the second end 50*b* will move downwards. Downward motion of the second end 50*b* can correspondingly cause the lift bracket 60 to move downwardly as well due to the engagement of the pin 53. Accordingly, downward motion of the lift bracket 60 can cause the moving rail 59 and, thus, the bin support structure 66 to move downwardly as well. The downward motion of the bin support structure 66 includes the bin support shelf 67, which also lowers the storage bin 18. Therefore, the first drive unit 28 is configured to output a vertical motion that is opposite to the direction of travel of the bin support structure 66, since upward vertical motion from the motor 42 causes the bin support structure 66 and storage bin 18 to lower, and vice versa.

Figure 6:
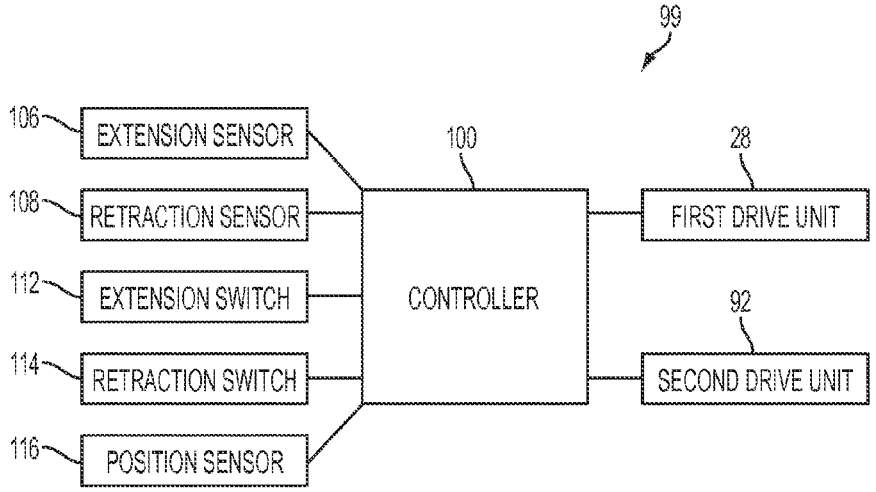
FIG. 6 is a block diagram showing the storage bin movement control system.

Turning now to FIG. 6, the control of the movement of the storage bin 18 can be governed using a storage bin movement control system 99. A block diagram is shown of the storage bin movement control system 99. As shown, one example of the storage bin movement control system 99 includes an extension sensor 106 and a retraction sensor 108 that are configured to sense when the storage bin 18 has been extended or retracted by the lift mechanism 32, respectively. In the shown example, the extended position corresponds to the upper or raised position and the retracted position corresponds to the lower or retracted position.

The storage bin movement control system 99 can further include a controller 100 that is operatively connected to the first drive unit 28. When activated, either the extension sensor 106 or retraction sensor 108 can send a signal to the controller 100 to deactivate the first drive unit 28, thereby stopping the motion of the storage bin 18. More specifically, the extension sensor 106 is configured to send a signal to the controller 100 to deactivate the first drive unit 28 when the storage bin 18 is in a fully extended and raised position. Likewise, the retraction sensor 108 is configured to send a signal to the controller 100 to deactivate the first drive unit 28 when the storage bin 18 is in a fully retracted and lowered position. The extension sensor 106 and the retraction sensor 108 may be limit switches that send a signal to the controller 100 upon contact with the storage bin 18 or the lift mechanism 32. Alternately, the sensors may be other types of sensors, such as optical sensors.

The user may activate the movement of storage bin 18 and the lift mechanism 32 in various different ways. For example, the movement of the storage bin 18 may be directly controlled by the user using switches. In the shown example, the storage bin movement control system 99 may include an extension switch 112 and a retraction switch 114. These switches may be positioned anywhere on the refrigerator 10. For example, as shown in FIG. 1, they may be positioned on the bin door 20. When the extension switch 112 is activated by the user, the controller 100 can send a signal to the first drive unit 28 to extend the lift mechanism 32 (e.g., move it upwards). Movement will then cease when the extension sensor 106 is activated. Likewise, when the retraction switch 114 is activated by the user, the controller 100 sends a signal to the first drive unit 28 to retract the lift mechanism 32 (e.g., move it downwards). In this case, movement will cease when the retraction sensor 108 is activated. Alternately, the extension switch 112 and retraction switch 114 can enable movement only when held down by the user. While the term "switch" has been used to describe the input device, it should be understood that the term, as used herein, encompasses a wide variety of other input devices, such as pushbuttons, levers, or the like.

As described above, the extension switch 112 and retraction switch 114 can be used to extend or retract the storage bin 18 in response to user input after the storage bin 18 has been manually withdrawn from the refrigerator compartment. To prevent operation of the lift mechanism 32 before the storage bin has cleared the refrigerator compartment, a position sensor 116 can be included. The position sensor 116 can be configured to detect when the storage bin 18 has been sufficiently withdrawn from the lower compartment 12 so that it can be raised without being blocked. For instance, the bin door 20 can be pulled out from the lower compartment 12. The bin door 20 can be either fully pulled out or near fully pulled out such that the storage bin 18 can freely be raised without striking the upper wall of the lower compartment 12. Accordingly, the position sensor 116 can be configured to signal to the controller 100 when the storage bin 18 is clear of obstructions and clear of the lower compartment 12, thereby enabling movement by the first drive unit 28. In further examples, the position sensor 116 may also be used to signal the first drive unit 28 to raise the storage bin 18 by extending the lift mechanism 32 automatically upon manual withdrawal of the storage bin 18. The position sensor 116 may also be configured to detect an attempt to close the bin door 20 and push the storage bin 18 back into the lower compartment 12 while the storage bin 18 is still in a raised position. In that example, the position sensor 116 can trigger the lowering of the storage bin 18 or provide a signal to the user that the storage bin 18 has not been lowered.

In further examples, the refrigerator 10 may also include a second drive unit 92 configured to move the slides 22 and the storage bin 18. For example, the second drive unit 92 can automatically retract the bin door 20 from the lower compartment 12, thereby exposing the storage bin 18. In such an example, the movement of the storage bin 18 along the slides 22 can be power-driven. For example, the second drive unit 92 may be included together with a second drive mechanism (not shown) that provides force to move the storage bin 18 out of (i.e., opening) and/or into (i.e., closing) the lower compartment 12. This may be done by applying force to the inner rail 24 in the slides 22. The second drive unit 92 can provide for opening and then raising the storage bin 18, or lowering and then closing the storage bin 18 through the coordinated action of the first drive unit 28 and the second drive unit 92. The coordinated opening and lifting and/or closing and lowering movements can be initiated in a variety of ways. For example, it may be initiated using the extension switch 112 and retraction switch 114, or it may be triggered by a slight push by the user on the bin door 20, which will either lower and close the storage bin 18 or open and raise the storage bin 18, depending on the current position of the storage bin 18. Further, the second drive unit 92 can be activated by a button, lever, switch, or the like. The controller 100 can provide an output that governs the activation of the second drive unit 92.

Figure 7:
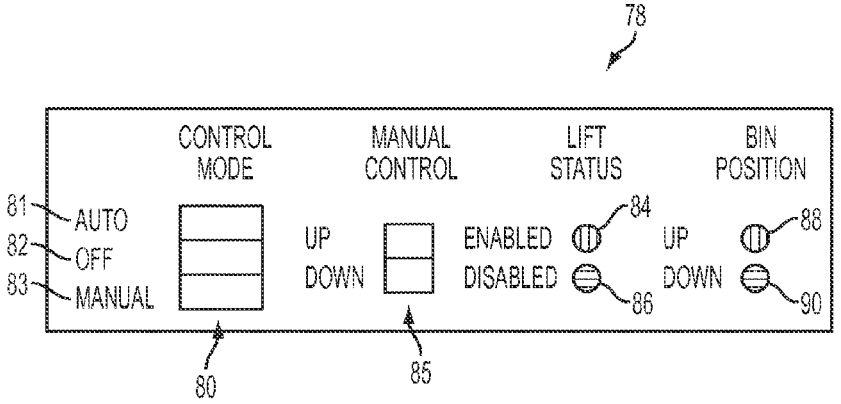
FIG. 7 is a front view of a user interface for the storage bin movement control system.

Referring now to FIG. 7, a control interface 78 is shown that can be used with the storage bin movement control system 99. The storage bin 18 can be used in place of the extension switch 112 and retraction switch 114. In this example, the user can switch between an automatic mode, a manual mode, and an off mode, to enable either automatic or manual control of the lift mechanism 32. To switch between automatic control, manual control, and off mode, a three position control mode switch 80 may be provided that includes an off position 82, an automatic position 81, and a manual position 83. In the off position 82, the lift mechanism 32 will not be signaled to move the storage bin 18. In the manual position 83, the lift mechanism 32 can move the storage bin 18 up or down in response to the position of a two position manual control switch 85, which has an up position and a down position, and operates in the two different modes described for the extension switch 112 and retraction switch 114. In the automatic position, the lift mechanism 32 will move away from whichever position it currently occupies (i.e., up or down) until it has either extended (e.g., raised) or lowered (e.g., retracted) completely, as registered by the extension sensor 106 and retraction sensor 108.

As described above, the lift mechanism 32 can operate if enabled by the position sensor 116. The position sensor 116 can indicate whether the storage bin 18 can be raised without striking an upper wall of the lower compartment 12. The control interface 78 may also provide information regarding whether the lift mechanism 32 is enabled, and/or what the current position of the storage bin 18 is. For example, the control interface 78 may include indicators such as indicator lights. In the example shown in FIG. 7, the control interface 78 includes four indicator lights, which illuminate to indicate present status of the lift mechanism and its control system. The indicator lights include a lift enabled indicator 84, and lift disabled indicator 86, a lift extended indicator 88, and a lift retracted indicator 90. The lift enabled indicator 84 can indicate whether the bin door 20 is completely or near completely withdrawn from the lower compartment 12, such that the storage bin 18 can safely be raised without striking the upper wall of the lower compartment 12. The lift disabled indicator 86 can indicate that the bin door 20 needs to be withdrawn further from the lower compartment 12, such that the storage bin 18 can be safely raised. The lift extended indicator 88 can indicate that the storage bin 18 has reached a fully raised or "UP" position. The lift retracted indicator 90 can indicate that the storage bin 18 has reached a fully lowered or "DOWN" position. It is to be understood that other methods and structures of indicating the present status of the lift mechanism are also contemplated, such as audible beeps, audible warning signals, or the like.

It is to be understood that the storage bin movement control system 99 and the control interface 78 could be positioned nearly anywhere on the refrigerator 10. For instance, in the shown example of FIG. 1, the storage bin movement control system 99 and the control interface 78 are shown to be positioned on an upper portion of the bin door 20. However, it is to be understood that the storage bin movement control system 99 and the control interface 78 could be positioned on the refrigerator doors 16, on the front face of the bin door 20, etc.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigerator, comprising:

a refrigerator compartment;

a bin door configured to restrict access to an interior of the refrigerator compartment;

a storage bin positioned within the refrigerator compartment; and a lift mechanism positioned within the refrigerator compartment, the lift mechanism including:

a bin support structure configured to support the storage bin;

at least one pivot arm pivotally attached to the bin support structure, the at least one pivot arm including a first end, a second end, and a pivot pin positioned between the first end and the second end; and a drive unit configured to apply a force to the at least one pivot arm at the first end to pivot the at least one pivot arm around the pivot pin, the pivoting of the at least one pivot pin being configured to raise and lower the bin support structure and storage bin in accordance with a corresponding direction in which the second end is raised and lowered by the pivoting of the at least one pivot arm around the pivot pin, wherein the first end of the at least one pivot arm is operatively attached to the drive unit by a pin extending through an elongated slot.

2. The refrigerator of claim 1, wherein the at least one pivot arm includes a first pivot arm and a second pivot arm.

3. The refrigerator of claim 1, wherein the second end of the at least one pivot arm is attached to the bin support structure.

4. The refrigerator of claim 1, wherein the first end of the at least one pivot arm is configured to move in an opposite direction from the second end of the at least one pivot arm.

5. The refrigerator of claim 1, further including a control system including a controller operatively connected to the drive unit.

6. The refrigerator of claim 5, wherein the control system includes an extension sensor configured to send a signal to the controller to deactivate the drive unit when the storage bin is in an extended position.

7. The refrigerator of claim 5, wherein the control system includes a retraction sensor configured to send a signal to the controller to deactivate the drive unit when the storage bin is in a retracted position.

8. The refrigerator of claim 5, wherein the control system includes a user interface with an extension switch and a retraction switch.

9. The refrigerator of claim 1, wherein the position of the pivot pin is nearer to a position of the first end than to a position of the second end of the at least one pivot arm.

10. The refrigerator of claim 1, wherein the at least one pivot arm comprises two pivot arms and the lift mechanism further comprises a connection link, the connection link comprising a connection block attached to a link bracket, wherein the connection block is secured to a moving cylinder of the drive unit such that vertical movement of the moving cylinder causes the connection block to move.

11. The refrigerator of claim 1, wherein the at least one pivot arm comprises two pivot arms and the lift mechanism further comprises a connection block, wherein the two pivot arms are attached to the connection block and the connection block is secured to a moving member of the drive unit such that movement of the moving member causes the two pivot arms to pivot.

12. The refrigerator of claim 1, wherein the elongated slot extends through the first end of the at least one pivot arm.

13. A refrigerator, comprising:

a refrigerator compartment including a bin door;

a storage bin positioned within the refrigerator compartment; and a lift mechanism positioned within the refrigerator compartment, the lift mechanism including:

a bin support structure configured to support the storage bin, a sliding system configured to vertically move the bin support structure; and at least one pivot arm mounted in a plane parallel with a front surface of the storage bin, the at least one pivot arm including a first end, a second end, and a pivot pin, the pivot pin being positioned between the first end and the second end, the pivot pin pivotally attaching the at least one pivot arm to the bin door, the at least one pivot arm being configured to pivot around the pivot pin in a plane parallel to the bin door, and a drive unit configured to apply a force to the at least one pivot arm at the first end to pivot the at least one pivot arm about the pivot pin, wherein the drive unit comprises a moving member attached to the at least one pivot arm that is configured to translate along a vertical axis that is fixed relative to the bin mounting structure, wherein the second end is operatively attached to the sliding system and configured to raise and lower the bin support structure and storage bin in accordance with a corresponding direction in which the second end is raised and lowered by the pivoting of the at least one pivot arm around the pivot pin.

14. The refrigerator of claim 13, wherein the lift mechanism is positioned within the bin door and configured to be surrounded by a cover.

15. The refrigerator of claim 13, wherein the sliding system comprises at least one slide rail, the at least one slide rail including a fixed rail portion and a moving rail portion.

16. The refrigerator of claim 15, wherein the moving rail portion is shorter in length than the fixed rail portion, and wherein the moving rail portion is configured to slide along a length of the fixed rail portion.

17. A refrigerator, comprising:

a refrigerator compartment including a bin door;

a storage bin positioned within the refrigerator compartment; and a lift mechanism positioned within the refrigerator compartment, the lift mechanism including:

a bin support structure configured to movably support the storage bin, at least one slide rail connected to and configured to vertically move the bin support structure;

at least one pivot arm pivotally attached to the bin support structure, the at least one pivot arm including a first end, a second end, and a pivot pin positioned between the first and the second end, the pivot pin pivotally attaching the at least one pivot arm to the bin door, the second end being operatively attached to the at least one slide rail; and a drive unit attached to the bin door and in operative association with the bin support structure, the first end being attached to the drive unit;

wherein the drive unit comprises a moving member attached to the at least one pivot arm that is configured to translate along a vertical axis that is fixed relative to the bin mounting structure, wherein the drive unit is configured to output linear motion in a direction parallel of the bin door and opposite to a direction of travel of the bin support structure, wherein, when the direction of the linear motion outputted by the drive unit is downward, the first end is lowered to rotate the at least one pivot arm around the pivot pin such that the second end is raised, thereby raising the at least one slide rail to raise the bin support structure and the storage bin, and wherein, when the direction of the linear motion outputted by the drive unit is upward, the first end is raised to rotate the at least one pivot arm around the pivot pin such that the second end is lowered, thereby lowering the at least one slide rail to lower the bin support structure and the storage bin.

18. The refrigerator of claim 17, wherein the drive unit includes a motor.

19. The refrigerator of claim 17, wherein the pivot pin is configured for pivotal attachment between the at least one pivot arm and the bin door at a position closer to the first end than the second end.

20. The refrigerator of claim 17, wherein the drive unit is attached parallel to the bin door.

* * * * *